US005417493A

United States Patent [19]

Ericson

[11] Patent Number: 5,417,493

[45] Date of Patent: May 23, 1995

[54] MIXING DEVICE FOR JOINT COMPOUND AND THE LIKE

[76] Inventor: Robert W. Ericson, Bookcliff Manor, 2897 Orchard Ave., Grand Junction, Colo. 81501

[21] Appl. No.: 235,474

[22] Filed: Apr. 29, 1994

[51] Int. Cl.[6] ..... B01F 7/32

[52] U.S. Cl. ..... 366/343; 366/129; 366/248

[58] Field of Search ..... 366/325, 343, 344, 342, 366/279, 285, 325, 129, 248, 247, 244

[56] References Cited

U.S. PATENT DOCUMENTS

| | | | |
|---|---|---|---|
| 2,490,015 | 12/1949 | Carman | 366/248 |
| 3,743,539 | 7/1973 | Kroyer | 366/325 |
| 3,894,723 | 7/1975 | Sanders | 366/248 |
| 4,049,243 | 9/1977 | Kramer | 366/248 |
| 4,422,770 | 12/1983 | Geible | 366/279 |
| 4,693,610 | 9/1987 | Weiss | 366/344 |

*Primary Examiner*—Robert W. Jenkins

[57] ABSTRACT

Disclosed is a new mixing device for joint compound and the like for mixing pre-blended and newly blended viscous liquid compounds within a cylindrical flat-bottomed container to obtain homogeneous consistency of the compound. The mixing device for joint compound and the like comprises a paddle member adapted to be rotatively driven by a conventional drill motor. The paddle member comprises a unitarily formed, essentially rigid rod having an elongated vertical shank portion with a collinearly formed chuck engagable portion on the proximal end thereof. An agitator blade portion is formed on the distal end of the shank portion. The agitator blade portion includes vertical and horizontal rod portions for efficient mixing of compound near the container sides and bottom. Angled rod portions are also included for efficient mixing of compound in the central area of the container.

7 Claims, 3 Drawing Sheets

PRIOR ART

MIXING DEVICE FOR JOINT COMPOUND AND THE LIKE

BACKGROUND OF THE INVENTION

1. Field of the Invention

The present invention relates to stirring devices and more particularly pertains to a mixing device for joint compound and the like which may be adapted for mixing pre-blended and newly blended viscous liquid compounds within a cylindrical flat-bottomed container by use of a drill motor powered stirring tool to obtain homogeneous consistency of the compound.

2. Description of the Prior Art

The use of stirring devices is known in the prior art. More specifically, stirring devices heretofore devised and utilized for the purpose of mixing and blending compounds for uniform consistency are known to consist basically of familiar, expected and obvious structural configurations, notwithstanding the myriad of designs encompassed by the crowded prior art which have been developed for the fulfillment of countless objectives and requirements.

The present invention is directed to improving devices for mixing and blending compounds for uniform consistency in a manner which is safe, secure, economical and aesthetically pleasing.

U.S. Pat. No. 4,083,653 to Stiffler describes a stirring device employing a shaft-mounted hub with five axially nested, radially extendable fins shaped to not only provide compact nesting of five fins to enter a bung opening of a drum, but also to provide ample surface area when extended for stirring. Likewise, U.S. Pat. Nos. 5,090,816 to Socha, 3,580,550 to Hunnicutt, and 5,073,033 to Klepeis also disclose motor driven horizontal radial impeller type mixing devices. None of the mixing apparatus described above has vertical and horizontal members specifically for agitating the substance being mixed adjacent the sides and bottom of the container.

The prior art also discloses a mixing apparatus as shown in U.S. Pat. No. 4,880,312 to Carlson which consists of a plurality of inwardly extending perimeter baffles and upwardly extending inner baffles to obstruct the free flow of liquid during the rotation of the container. While the mixing device described here fulfills its particular objectives and requirements, the aforementioned patent does not disclose a mixing device for joint compound and the like for mixing pre-blended and newly blended viscous liquid compounds within a cylindrical flat-bottomed container by use of a drill motor powered stirring tool.

In this respect, the mixing device for joint compound and the like according to the present invention substantially departs from the conventional concepts and designs of the prior art, and in so doing provides an apparatus primarily developed for the purpose of mixing pre-blended and newly blended viscous liquid compounds within a cylindrical flat-bottomed container by use of a drill motor powered stirring tool to obtain homogeneous consistency of the compound.

Therefore, it can be appreciated that there exists a continuing need for a new mixing device for joint compound and the like which can be used for mixing pre-blended and newly blended viscous liquid compounds within a cylindrical flat-bottomed container by use of a drill motor powered stirring tool to obtain homogeneous consistency of the compound. In this regard, the present invention substantially fulfills this need.

As illustrated by the background art, efforts are continuously being made in an attempt to develop devices for mixing and blending compounds for uniform consistency. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of stirring devices now present in the prior art, the present invention provides a new stirring devices construction wherein the same can be utilized for mixing pre-blended and newly blended viscous liquid compounds within a cylindrical flat-bottomed container by use of a drill motor powered stirring tool to obtain homogeneous consistency of the compound. As such, the general purpose of the present invention, which will be described subsequently in greater detail, is to provide a new mixing device for joint compound and the like apparatus and method which has all the advantages of the prior art stirring devices and none of the disadvantages.

The invention is defined by the appended claims with the specific embodiment shown in the attached drawings. For the purpose of summarizing the invention, the invention may be incorporated into a new mixing device for joint compound and the like for mixing pre-blended and newly blended viscous liquid compounds within a cylindrical flat-bottomed container to obtain homogeneous consistency of the compound. The mixing device for joint compound and the like comprises a paddle member adapted to be rotatively driven by a conventional drill motor having a chuck. The paddle member comprises a unitarily formed, essentially rigid rod having an elongated vertical shank portion with a collinearly formed chuck engagable portion on the proximal end thereof. An agitator blade portion is formed on the distal end of the shank portion. The agitator blade portion comprises a vertical rod portion for efficient mixing of compound near the container sides, the vertical rod portion being offset from the vertical shank portion by an angled shoulder portion. A bottom horizontal rod portion, for efficient mixing of compound near the container bottom, extends normal the lower end of the vertical rod portion. The horizontal rod portion shares the plane defined by the combined shank, vertical, and shoulder portions. First and second angled rod portions extend upwardly from the free end of the horizontal portion for efficient mixing of compound in the central area of the container. The upper end of the first angled portion is fixedly connected to the shoulder portion proximal the shank portion. The upper end of the second angled portion is fixedly connected to the shoulder portion intermediate the shank portion and the vertical portion.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a mixing device for joint compound and the like for mixing pre-blended and newly blended viscous liquid compounds by use of a drill motor powered stirring tool to obtain homogeneous consistency of the compound.

It is another object of the present invention to provide a new mixing device for joint compound and the like which may be easily and efficiently manufactured and marketed.

It is a further object of the present invention to provide a new mixing device for joint compound and the like which is of a durable and reliable construction.

An even further object of the present invention is to provide a new mixing device for joint compound and the like which is susceptible of a low cost of manufacture with regard to both materials and labor, and which accordingly is then susceptible of low prices of sale to the consuming public, thereby making such mixing devices for joint compound and the like economically available to the buying public.

Still yet another object of the present invention is to provide a new mixing device for joint compound and the like which provides in the apparatuses and methods of the prior art some of the advantages thereof, while simultaneously overcoming some of the disadvantages normally associated therewith.

Still yet another object of the present invention is to provide a new mixing device for joint compound and the like that is constructed to efficiently stir the compound close to the vertical sides and flat bottom of the container.

Yet another object of the present invention is to provide a new mixing device for joint compound and the like that has a relatively small surface area for efficiently blending highly viscous compounds.

Even still another object of the present invention is to provide a new mixing device for joint compound and the like that is easily cleaned.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
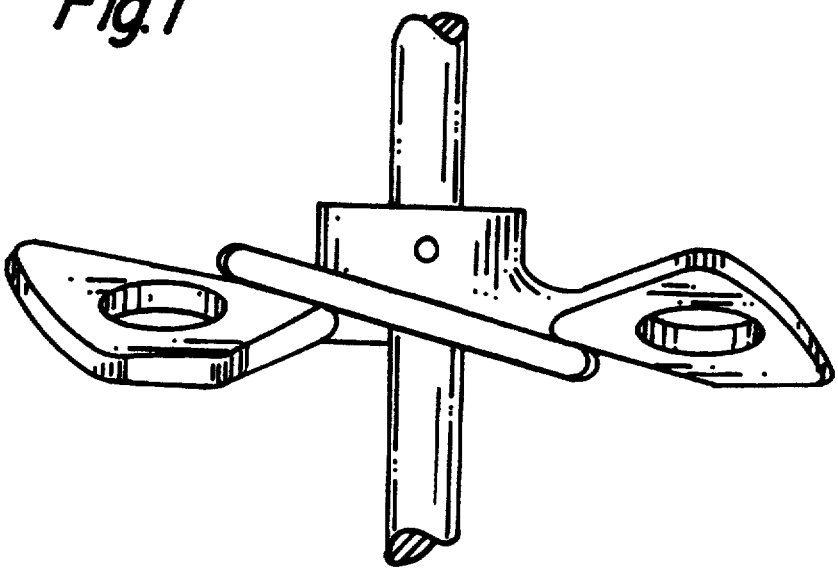
FIG. 1 illustrates a prior art stirring device.
Figure 2:
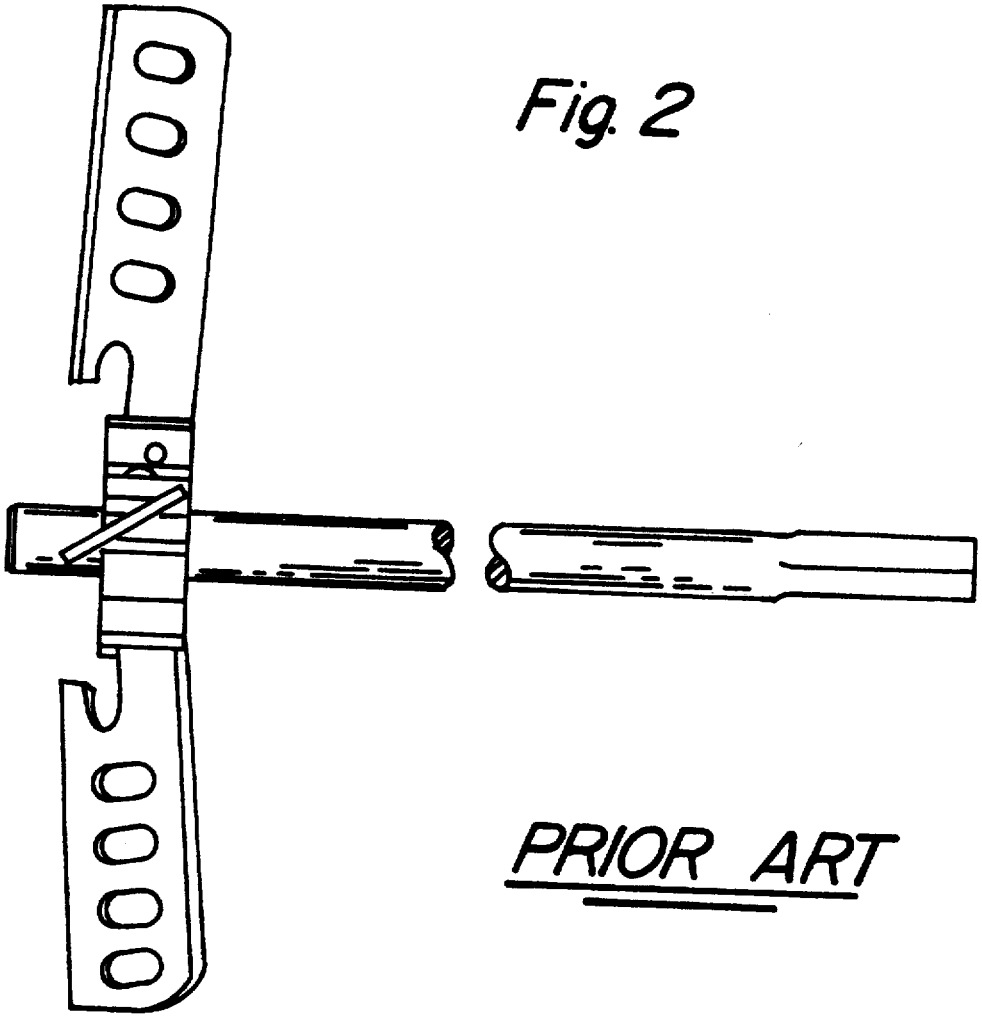
PRIOR ART Fig. 2
FIG. 2 illustrates a second prior art stirring device.
Figure 3:
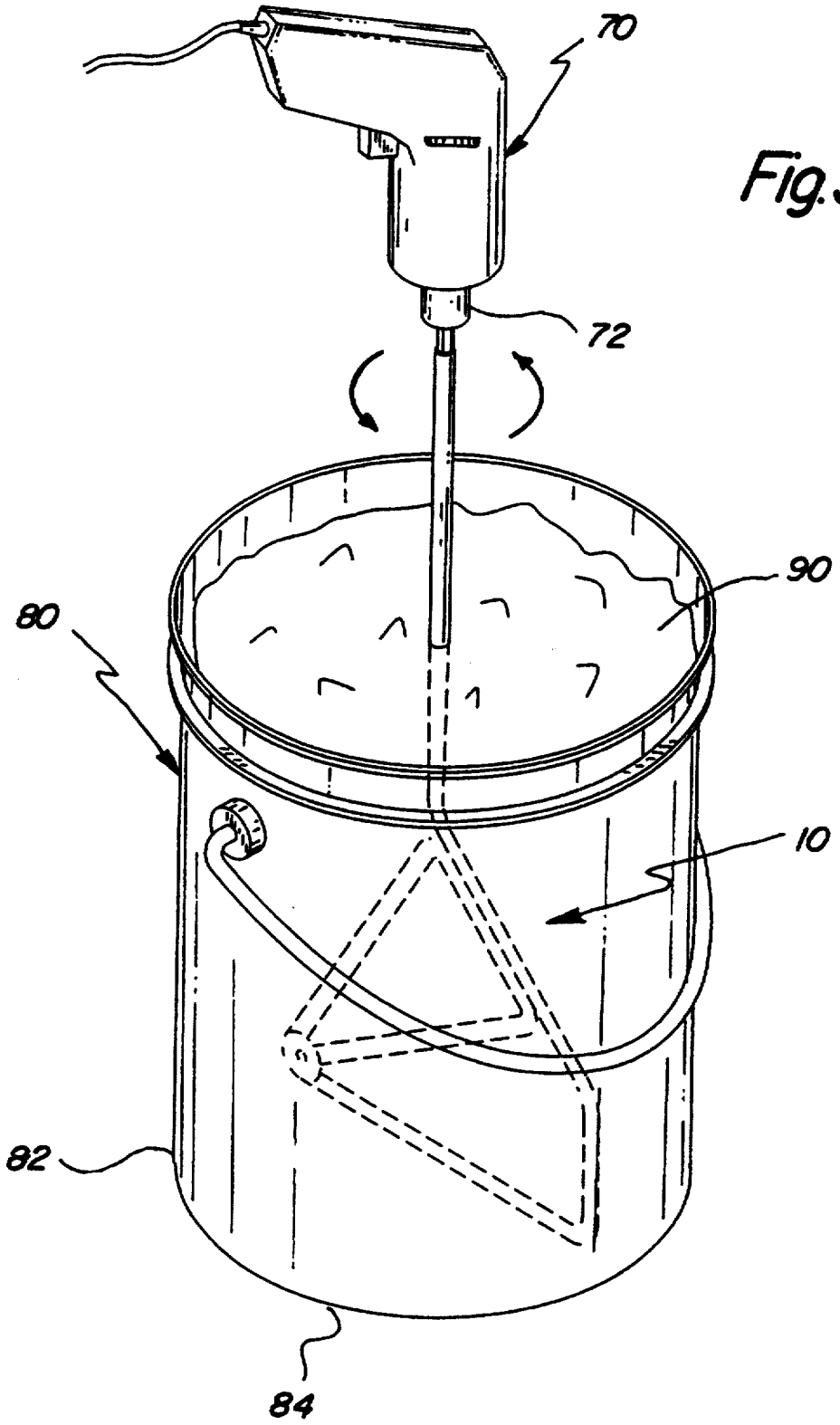
FIG. 3 is a perspective view of the mixing device for joint compound and the like of the present invention showing its manner of use.

With reference now to the drawings, and in particular to FIG. 3 thereof, a new mixing device for joint compound and the like embodying the principles and concepts of the present invention and generally designated by the reference numeral 10 will be described.

From an overview standpoint, the mixing device for joint compound and the like is adapted for use for mixing pre-blended and newly blended viscous liquid compounds within a cylindrical flat-bottomed container by use of a drill motor powered stirring tool to obtain homogeneous consistency of the compound. See FIG. 3.

Figure 4:
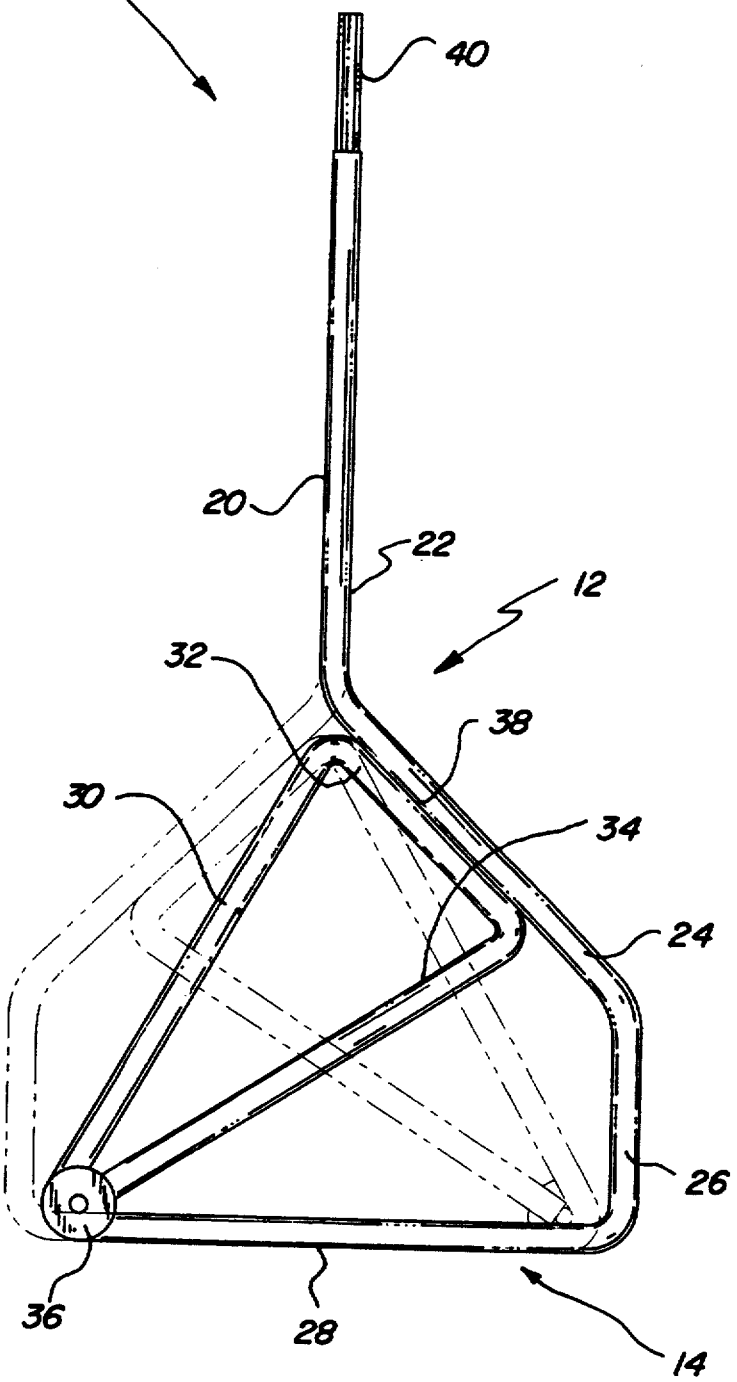
FIG. 4 is a front elevational view of the present invention illustrating the pattern of angled mixing rods generated by rotating the device 180°.
Figure 5:
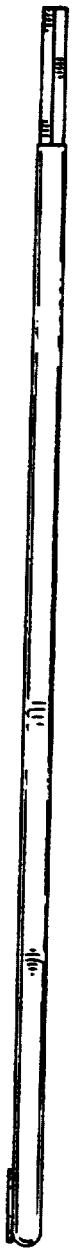
FIG. 5 is a side elevational view of the invention of FIG. 4.

With reference now to FIGS. 3, 4, and 5 and more specifically, it will be noted that a new mixing device for joint compound and the like 10 is shown. The mixing device for joint compound and the like 10 comprises a paddle member 12 adapted to be rotatively driven by a conventional drill motor 70 having a chuck 72. The paddle member 12 comprises a unitarily formed, essentially rigid rod 20 having an elongated vertical shank portion 22 with a collinearly formed chuck engagable portion 40 on the proximal end thereof. An agitator blade portion 14 is formed on the distal end of the shank portion 22. The agitator blade portion 14 comprises a vertical rod portion 26 for efficient mixing of compound 90 near the container sides 82, the vertical rod portion 26 being offset from the vertical shank portion 22 by an angled shoulder portion 24, forming a 45° angle relative the shank portion 22. A bottom horizontal rod portion 28, for efficient mixing of compound 90 near the container bottom 84, extends normal the lower end of the vertical rod portion 26.

The horizontal rod portion 28 shares the plane defined by the combined shank 22, vertical 26, and shoulder 24 portions. A first angled rod portion 30 extends upwardly from the free end of the horizontal portion 28 at a 60° angle relative the horizontal portion 28 and lying on the same plane as the aforementioned rod portions 22, 24, 26, and 28. A third angled rod portion 38 extends downwardly from the upper end of the first rod portion 30 to lie in touching parallel contact with the shoulder portion 24, the third angled portion 38 being welded to the shoulder portion 24. A second angled rod portion 34 extends downwardly from the lower end of the third rod portion 38 to terminate at the juncture of the horizontal portion 28 and the first angled portion 30. The second rod portion 34 lies at a 30° angle relative the horizontal rod portion 28. A reinforcing gusset 36 is welded to the rod portions 28, 30, and 34 at the point where they converge to strengthen the agitator blade 14 to withstand the deforming forces present when mixing thick compounds. The angled rod portions 24, 30, and 34 effectively mix the compound in the central area of the container as the agitator blade 14 rotates through 360° of travel.

In use, the rotating agitator blade 14 is worked in simultaneous circular and vertical oscillating motions around the inside wall 82 of the container.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described,

What is claimed is:

1. A new mixing device for joint compound and the like for mixing pre-blended and newly blended viscous liquid compounds within a cylindrical flat-bottomed container to obtain homogeneous consistency of the compound, the mixing device for joint compound and the like comprising:

a paddle member adapted to be rotatively driven by a conventional drill motor having a chuck, the paddle member comprising: a unitarily formed essentially rigid rod having an elongated vertical shank portion with a collinearly formed chuck engagable portion on the proximal end thereof; an agitator blade portion formed on the distal end of the shank portion, the agitator blade portion comprising a vertical rod portion for efficient mixing of compound near the container sides, the vertical rod portion being offset from the vertical shank portion by an angled shoulder portion, a bottom horizontal rod portion for efficient mixing of compound near the container bottom, the horizontal rod portion extending normal the lower end of the vertical rod portion, the horizontal rod portion sharing the plane defined by the combined shank, vertical, and shoulder portions, first and second angled rod portions extending upwardly from the free end of the horizontal portion for efficient mixing of compound in the central area of the container, the upper end of the first angled portion being fixedly connected to the shoulder portion proximal the shank portion, the upper end of the second angled portion being fixedly connected to the shoulder portion intermediate the shank portion and the vertical portion.

2. The mixing device for joint compound and the like of claim 1 wherein the angle formed by the angled shoulder portion is 45° with respect to the vertical shank portion.

3. The mixing device for joint compound and the like of claim 2 wherein the angle formed by the first angled portion is 60° with respect to the horizontal portion.

4. The mixing device for joint compound and the like of claim 3 wherein the angle formed by the second angled portion is 30° with respect to the horizontal portion.

5. The mixing device for joint compound and the like of claim 4 wherein the chuck engagable portion is hexagonal in cross section.

6. The mixing device for joint compound and the like of claim 5 wherein the rod is formed of steel having a 0.25-inch diameter.

7. The mixing device for joint compound and the like of claim 6 and further including a reinforcing gusset fixedly connected to the converging point of the horizontal portion, the first angled portion, and the second angled portion.

* * * * *